US006341157B1

(12) United States Patent
Sakabe

(10) Patent No.: US 6,341,157 B1
(45) Date of Patent: Jan. 22, 2002

(54) ROTATION ANTICATHODE-X RAY GENERATING EQUIPMENT

(76) Inventor: Noriyoshi Sakabe, 3-101, Tsukuba-Kasuga-Danchi, 37, Kasuga 2-Chome, Tsukuba City, Ibaragi Pref. (JP)

( * ) Notice: Subject to any disclaimer, the term of this patent is extended or adjusted under 35 U.S.C. 154(b) by 0 days.

(21) Appl. No.: 09/584,090

(22) Filed: May 31, 2000

(51) Int. Cl.[7] ..... H01J 35/10
(52) U.S. Cl. ..... 378/144; 378/143
(58) Field of Search ..... 378/144, 133, 378/132, 122, 143

(56) References Cited

U.S. PATENT DOCUMENTS 3,934,164 A * 1/1976 Braun et al. ..... 313/60
4,103,198 A * 7/1978 Braun ..... 313/60
4,166,231 A * 8/1979 Braun ..... 313/60
4,608,707 A * 8/1986 Gabbay et al. ..... 378/132
5,838,763 A * 11/1998 Hiller et al. ..... 378/133

* cited by examiner

*Primary Examiner*—Robert H. Kim
*Assistant Examiner*—Irakli Kiknadze
(74) *Attorney, Agent, or Firm*—Oliff & Berridge

(57) ABSTRACT

A rotation anticathode-X ray generating equipment includes a rotation anticathode and a cathode. The electron beam for the anticathode from the cathode is irradiated to the area of the surface of the anticathode on which a centrifugal force acts toward the inner side of the surface of the anticathode from the outer side thereof when the anticathode rotates. As a result, a X ray is generated in very high flux.

17 Claims, 2 Drawing Sheets

ROTATION ANTICATHODE-X RAY GENERATING EQUIPMENT

BACKGROUND OF THE INVENTION

1. Field of the Invention

This invention relates a rotation anticathode-X ray generating equipment which is capable of generating a X ray having a super high luminance.

2. Description of the Prior Art

A X ray diffraction measurement, etc., often requires the irradiation of a X ray having a maximum intensity for a sample. In this case, conventionally, a rotation anticathode-X ray generating equipment has been used as a X ray generating equipment.

In the rotation anticathode-X ray generating equipment, the X ray is generated by irradiating electron beams for the outer surface of a cylindrical anticathode (target) with rotation in which a cooling solvent flows. Compared with a fixed target type X ray generating equipment in which the target is fixed, the rotation anticathode X ray generating equipment has various irradiation positions of the electron beams with time, so that it can have extremely large cooling efficiency. Therefore, the rotation anticathode-X ray generating equipment can irradiate the electron beams having large currents for the anticathode and thereby, can generate strong intensity (high luminance) X rays.

Generally, the output of the X ray corresponds to the electric power (current x voltage) to be applied between the cathode and the anticathode. Therefore, in exhibiting the output power of the X ray by the electric power, the above conventional rotation anticathode-X ray generating equipment, in which the electron beam having a spot diameter of 0.1×1 mm are irradiated on the target, can have a maximum electric power of 1.2 kW, and even a super high luminance type rotation anticathode-X ray generating equipment can have a maximum electric power of 3.5 kW at best.

SUMMARY OF THE INVENTION

This invention is found out in the above background, and has as an object the provision of a rotation anticathode X ray generating equipment which is capable of generating a X ray beyond the limitation of the output in the conventional rotation anticathode-X ray generating equipment.

To iron out the above problem, the first invention is directed to a rotation anticathode-X ray generating equipment comprising a rotation anticathode and a cathode, wherein the electron beam for the anticathode from the cathode is irradiated to the area of the surface of the anticathode on which a centrifugal force acts toward the inner side of the anticathode from the outer side thereof when the anticathode rotates, and thereby, a X ray is generated.

In a preferred embodiment of the rotation anticathode-X ray generating equipment of the present invention, the anticathode comprises a cylinder, and by irradiating the electron beam to the inner side surface of the cylinder, the X ray is generated.

In the above invention, the electron beams are irradiated to the area of the surface of the anticathode on which a centrifugal force acts toward the inner side of the anticathode from the outer side thereof. Therefore, even if the area of the surface of the anticathode is almost melted by the irradiation of the electron beam, it is supported by the structural body inside the anticathode, so that the deformation and the destruction of the anticathode can be effectively inhibited. Consequently, the current of the electron beam to be irradiated can be increased until the temperature of the surface of the anticathode almost reach the melting point of the material constituting the anticathode.

On the contrary, in the conventional rotation anticathode-X ray generating equipment, the centrifugal force due to the rotation acts toward the outer of the anticathode from the area on which the electron beams are irradiated. Therefore, for maintaining the surface shape of the anticathode against the centrifugal force, the surface of the anticathode is required to be maintained at a much lower temperature (about below ½) than the melting point of the material constituting the anticathode. Consequently, the current of the electron beams to be irradiated is restricted so that the surface temperature of the anticathode may not be more than the temperature range.

On the contrary, since the deformation of the anticathode due to the centrifugal force can be remarkably reduced according to the present invention, the surface temperature of the anticathode can be increased up to the temperature near or beyond the melting point, which is 2.5 times or over as high as the conventional temperature range. Therefore, the rotation anticathode-X ray generating equipment can have an allowable loading electric power of 2.5 times or over as large as the maximum allowable loading electric power of the conventional super high luminance type rotation anticathode-X ray generating equipment.

BRIEF DESCRIPTION OF THE DRAWINGS

For better understanding of the present invention, reference is made to the attached drawings, wherein.

DESCRIPTION OF THE PREFERRED EMBODIMENTS

Figure 1:
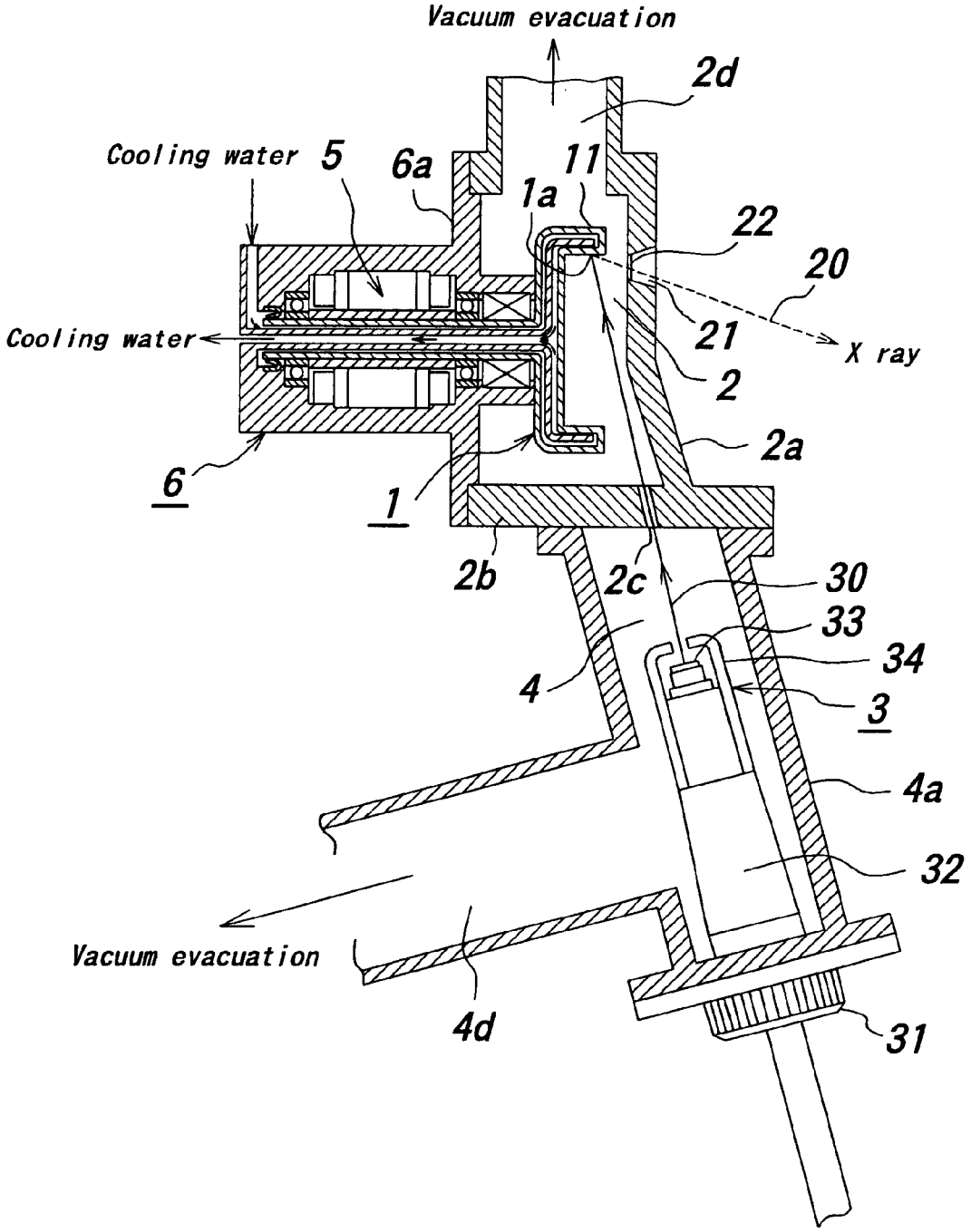
FIG. 1 is a cross sectional view showing an embodiment of the rotation anticathode X ray generating equipment of the present invention and FIG. 2 is a cross sectional view showing in enlargement a part of the X ray generating equipment shown in FIG. 1.
Figure 2:
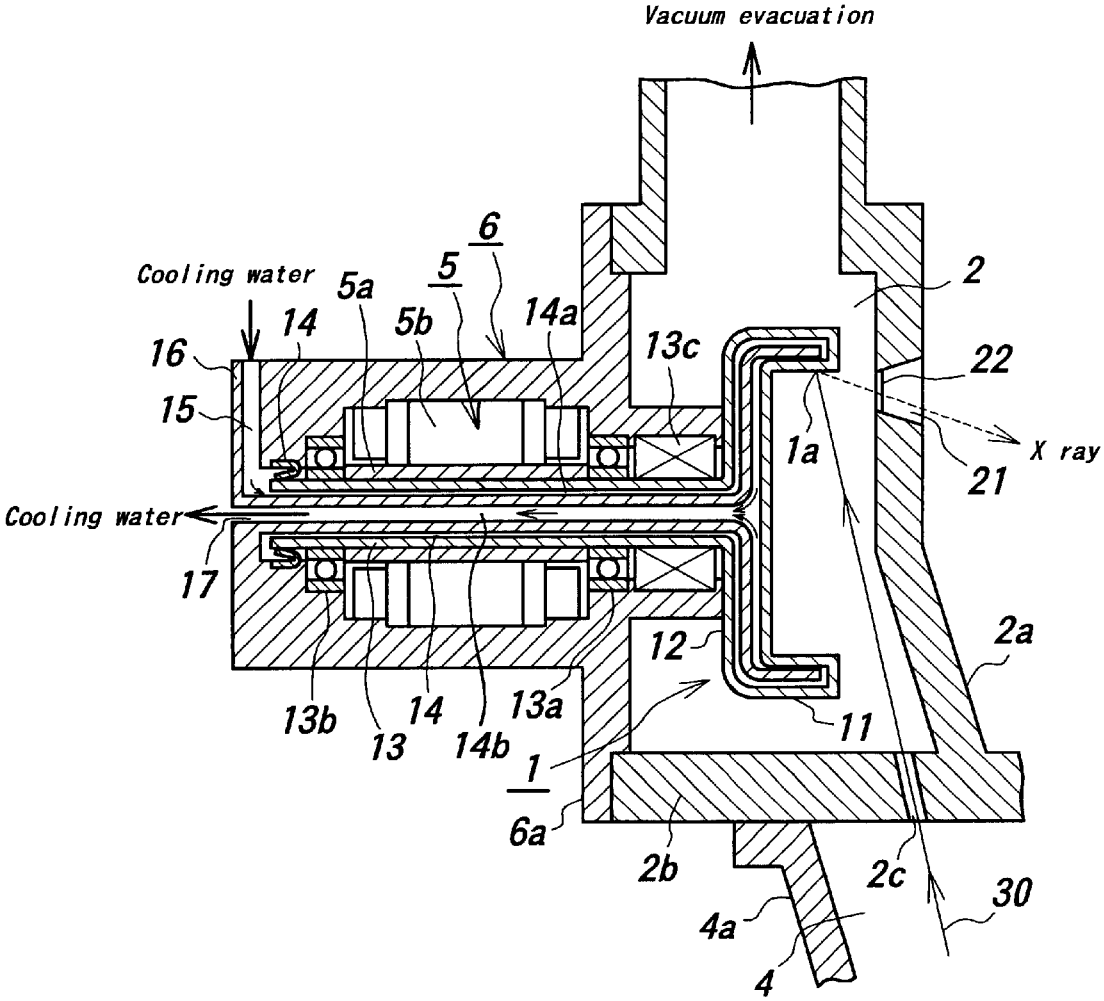

FIG. 1 is a cross sectional view showing an embodiment of the X ray generating equipment of the present invention, and FIG. 2 is an enlarged section view showing a part of the X ray generating equipment shown in FIG. 2. The invention will be described in detail with reference to the figures hereinafter.

In the figures, the rotation anticathode-X ray generating equipment has an anticathode chamber 2 to accommodate a rotation anticathode 1, a cathode chamber 4 to accommodate a cathode 3 and a rotation driving part 6 having a driving motor 5 to drive the rotation anticathode in rotation, which are neighboring one another and made of dense structural members 2*a*, 4*a* and 6*a*, respectively. Moreover, a partition 2*b*, which separates the anticathode chamber 2 and the cathode chamber 4, has a small throughout hole 2*c* to pass through the electron beam from the cathode 3. Then, the anticathode chamber 2 and the cathode chamber 4 have vacuum exhaust holes 2*d* and 4*d* to connect a vacuum evacuating equipment, not shown.

In the above X ray generating equipment, the anticathode chamber for the anticathode to be accommodated and the cathode chamber for the cathode to be accommodated are separated and made of the dense structural members. Then, the anticathode chamber and the cathode chamber are connected to the vacuum evacuating equipment, respectively and independently evacuated. Therefore, the change of the vacuum degree near the electron beam-irradiation area of the anticathode dose not almost influence the vacuum degree near the cathode, so that irregular discharges can not be repressed.

The rotation anticathode 1 is composed of a cylinder 1 made Cu, etc., a circular plate 12 formed so as to close the one end of the cylinder 1 and a rotation shaft 13 having the common central axis to the cylinder 11 and the circular plate 12, which are combined. Then, the rotation anticathode 1 is hollow inside, and the inner side surface of the cylinder 11 corresponds to the electron beam-irradiating area.

The rotation shaft 13 of the rotation anticathode 1 is supported by a pair of bearings 13*a* and 13*b* provided in the rotation driving part 6 so as to rotate freely. Moreover, a rotator 5*b* for the driving motor 5 is attached on the outer of the rotation shaft 13, and a stator 5*a* to rotate the rotator 5*b* is attached to the dense structural member 6*a* in the rotation driving part 6.

At the root of the rotation shaft 13 in the side of the circular plate 12 is provided a rotation shaft-shielding member 13*c* to maintain the anticathode chamber 2 in vacuum through holding the space between the rotation shaft 13 and the dense structural member 6*a* in air tight.

Moreover, in the rotation anticathode 1 is provided a fixed partition member 14 to flow a cooling water alongside the inside walls of the electron beam-irradiating area la. The fixed partition member 14 has a cylindrical shape at the rotation shaft 13 and has an enlarged circular plate-like shape at the circular plate 12, elongated to the inside wall of the right edge of the cylinder 11.

That is, the interior of the rotation anticathode 1 is separated by the fixed partition member 14 so as to have a double tube structure. The outer tube 14*a* of the double tube structure is connected to a cooling water inlet 15. At the left edge of the rotation shaft 13 is provided a shaft shielding member 16 not to leak the cooling water from the inlet 15 for the bearing 13*b* and into the accommodating space of the driving motor 5 and to introduce it into the outer tube 14.

Therefore, the cooling water from the inlet 15 proceeds in the outer tube 14 of the double tube, turning at the inside wall of the right edge of the cylinder 11, and proceeds in the inner tube 14*b* of the double tube. Thereby, the inside wall of the electron beam-irradiating area 1*a* is cooled, and then, the cooling water proceeds in the inner tube 14*b*, exhausted outside from a cooling water outlet 17.

The dense structural member 2a near the electron beam-irradiating area 1*a* of the rotation anticathode 1 has the X ray window 21 to take out to the outside the X ray 20 generated by the irradiation of an electron beam 30. The X ray window 21 is composed of a X ray-penetrating film 22 made of a material having a X ray-penetrating characteristic such as Be or Ni. Thereby, the X ray is taken out with maintaining the anticathode chamber 2 in vacuum.

The cathode 3 is composed of an insulating structural part 32, a filament 33, a wehnelt 34, etc., and irradiates the electron beam 30 for the anticathode 1 by a high voltage-electric power of several ten kV introduced from a high voltage-introducing part 31 and a filament electric power.

According to the above X ray generating equipment, by introducing the cooling water from the cooling water inlet 15, rotating the rotation anticathode cathode 1 at high speed with the driving motor 5 and by irradiating the electron beam 30 on the electron beam-irradiating area 1*a*, the X ray can be generated.

Since the above X ray generating equipment can reduce the deformation of the anticathode due to the centrifugal force remarkably, it can increase the temperature of the anticathode surface to the temperature near or more than the melting point of the material constituting the anticathode, which is 2.5 times or over as high as the temperature of the conventional anticathode surface. Therefore, the rotation anticathode-X ray generating equipment of the present invention can have an allowable loading electric power of at least 2.5 times or over as large as the maximum allowable loading electric power of the conventional super high luminance type X ray generating equipment.

In the above embodiment, the inner side walls of the cylinder 11 which constitute the electron beam-irradiating area 1*a* are not processed and not deformed, and thus, are parallel to the rotation shaft. However, the inner side walls may be processed so as to be inclined relative to the rotation shaft by an angle of several degrees to several ten degrees. If the inner side walls area inclined toward the side of the cylinder 11, it can prevent the melted part of the electron beam-irradiating area 1*a* from scattering beyond the rotation anticathode 1. If the inner side walls is inclined toward the outside of the cylinder 11, it can help take out the X ray outside.

Moreover, the inner side area of the cylinder 11 constituting electron beam-irradiating area 1*a* may have a V-shaped ditch or a U-shaped ditch, which prevents the melted part of the electron beam-irradiating area 1*a* from scattering beyond the rotation anticathode 1 effectively. In this case, the V-shaped ditch or the U-shaped ditch should be formed so as to have the width, the depth and the inclined angle thereof to take out the X ray easily. Furthermore, the U-shaped ditch may have a curved shape similar to the shape of the melted part of the electron beam-irradiating area 1*a* when the centrifugal force acts on the melted part, which can repress the deformation of the rotation anticathode surface.

Moreover, only the electron beam-irradiating area 1*a* may be composed of a target material which is determined on the kind of the X ray to be generated, and the nearby area may be composed of a material having a high melting point and/or a high thermal conductivity, which can enhance the cooling efficiency of electron beam-irradiating area 1*a* composed of the target material and repress of the deformation of the rotation anticathode surface. Consequently, the X ray generating equipment can generate the X ray having a high output power.

In the X ray generating equipment of the present invention, the temperature of the electron beam-irradiating area 1*a* is often set to the temperature near or more than the melting point of the material constituting the anticathode, as mentioned above. In this case, the electron beam-irradiating area is partially melted and evaporated, resulting in the increase of the atmosphere in the anticathode chamber 2. As a result, the evaporated material is often stuck and pollutes the X ray-penetrating film 22. Therefore, to prevent the pollution, it is desired that an exchangeable X ray-penetrating protection film is provided in front of the X ray-penetrating film 22. As the protection film, a Ni film capable of withstand recoil electrons may be used. Moreover, it is desired that a supply roll and a wind roll are provided in each side of the X ray window 21 and the long tape like protection film is prepared between the supply roll and the wind roll in the front of the X ray-penetrating film 22.

Although the present invention was described in detail with reference to the above examples, this invention is not limited to the above disclosure and every kind of variation and modification may be made without departing from the scope of the present invention.

As mentioned above, in the rotation anticathode X ray generating equipment of the present invention, the electron beams are irradiated onto the area of the surface of the rotation anticathode on which the centrifugal force acts toward the inner side of the anticathode from the outer side thereof. Therefore, the current of the electron beams to be irradiated can be increased until the surface of the anticathode is almost melted. As a result, the rotation anticathode-X ray generating equipment which can generates a X ray having an extremely large output power beyond the output limitation of the conventional rotation anticathode-X ray generating equipment can be obtained.

What is claimed is:

1. A rotation anticathode-X ray generating equipment comprising a rotation anticathode and a cathode, wherein the electron beam for the anticathode from the cathode is irradiated to the area of the surface of the anticathode on which a centrifugal force acts toward the inner side of the anticathode from the outer side thereof when the anticathode rotates, and thereby, a X ray is generated.

2. A rotation anticathode-X ray generating equipment as defined in claim 1, wherein the anticathode comprises a cylinder, and by irradiating the electron beam to the inner side surface of the cylinder, the X ray is generated.

3. A rotation anticathode-X ray generating equipment as defined in claim 2, comprising an anticathode chamber to accommodate the anticathode and a cathode chamber to accommodate the cathode which are separated and made of a dense structural material, the anticathode chamber and the cathode chamber being connected to vacuum evacuating equipment and independently evacuated, the partition between the anticathode chamber and the cathode chamber having a throughout hole to pass through the electron beam from the cathode.

4. A rotation anticathode-X ray generating equipment as defined in claim 2, wherein the area of the surface of the anticathode on which the electron beam is irradiated is parallel to the rotation axis of the anticathode.

5. A rotation anticathode-X ray generating equipment as defined in claim 2, wherein the area of the surface of the anticathode on which the electron beam is irradiated in inclined relative to the rotation axis of the anticathode.

6. A rotation anticathode-X ray generating equipment as defined in claim 2, wherein the area of the surface of the anticathode on which the electron beam is irradiated has a V-shaped ditch or a U-shaped ditch.

7. A rotation anticathode-X ray generating equipment as defined in claim 2, wherein only the area of the surface of the anticathode on which the electron beam is irradiated is made of the material constituting the anticathode, and the nearby area is made of a material having at least one of a high melting point and a high thermal conductivity.

8. A rotation anticathode-X ray generating equipment as defined in claim 1, comprising an anticathode chamber to accommodate the anticathode and a cathode chamber to accommodate the cathode which are separated and made of a dense structural material, the anticathode chamber and the cathode chamber being connected to vacuum evacuating equipment and independently evacuated, the partition between the anticathode chamber and the cathode chamber having a throughout hole to pass through the electron beam from the cathode.

9. A rotation anticathode-X ray generating equipment as defined in claim 8, wherein the anticathode chamber comprises a X ray window with a X ray-penetrating film to take out the generated X ray and a protection film for the X ray-penetrating film.

10. A rotation anticathode-X ray generating equipment as defined in claim 9, wherein a supply roll and a wind roll are provided in each side of the X ray window, and the protection film is set between the supply roll and the wind roll.

11. A rotation anticathode-X ray generating equipment as defied in claim 1, wherein the area of the surface of the anticathode on which the electron beam is irradiated is parallel to the rotation axis of the anticathode.

12. A rotation anticathode-X ray generating equipment as defined in claim 1, wherein the area of the surface of the anticathode on which the electron beam is irradiated is inclined relative to the rotation axis of the anticathode.

13. A rotation anticathode-X ray generating equipment as defined in claim 12, wherein the area of the inner side surface of the cylinder on which the electron beam is irradiated is inclined toward the inner side of the anticathode.

14. A rotation anticathode-X ray generating equipment as defined in claim 12, wherein the area of the inner side surface of the cylinder on which the electron beam is irradiated is inclined toward the outer side of the anticathode.

15. A rotation anticathode-X ray generating equipment as defined in claim 1, wherein the area of the surface of the anticathode on which the electron beam is irradiated has a V-shaped ditch or a U-shaped ditch.

16. A rotation anticathode-X ray generating equipment as defined in claim 15, wherein the U-shaped ditch may have a curved shape similar to the shape of the melted part, at the time when the centrifugal force acts on the melted part, of the area of the inner side surface of the cylinder on which the electron beam is irradiated.

17. A rotation anticathode-X ray generating equipment as defined in claim 1, wherein only the area of the surface of the anticathode on which the electron beam is irradiated is made of the material constituting the anticathode, and the nearby area is made of a material having at least one of a high melting point and a high thermal conductivity.

* * * * *